US011413722B2

(12) United States Patent
Lee

(10) Patent No.: US 11,413,722 B2
(45) Date of Patent: Aug. 16, 2022

(54) APPARATUS AND METHOD FOR CHEMICALLY MECHANICALLY POLISHING

(71) Applicant: TAIWAN SEMICONDUCTOR MANUFACTURING COMPANY LTD., Hsinchu (TW)

(72) Inventor: Bo-I Lee, Taipei County (TW)

(73) Assignee: TAIWAN SEMICONDUCTOR MANUFACTURING COMPANY LTD.', Hsinchu (TW)

( * ) Notice: Subject to any disclaimer, the term of this patent is extended or adjusted under 35 U.S.C. 154(b) by 0 days.

(21) Appl. No.: 16/902,053

(22) Filed: Jun. 15, 2020

(65) Prior Publication Data

US 2020/0306929 A1 Oct. 1, 2020

Related U.S. Application Data

(62) Division of application No. 14/101,962, filed on Dec. 10, 2013, now abandoned.

(51) Int. Cl.
*B24B 53/017* (2012.01)

(52) U.S. Cl.
CPC ..... *B24B 53/017* (2013.01); *Y10T 29/49815* (2015.01)

(58) Field of Classification Search
None
See application file for complete search history.

(56) References Cited

U.S. PATENT DOCUMENTS 4,273,506 A * 6/1981 Thomson ..... B25J 9/046 294/106
6,062,955 A * 5/2000 Liu ..... B24B 37/30 451/72
6,213,856 B1 * 4/2001 Cho ..... B24D 18/0072 451/443
6,334,810 B1 * 1/2002 Song ..... B24B 53/017 451/60
6,341,997 B1 * 1/2002 Lin ..... B08B 5/02 134/19
8,342,910 B2 * 1/2013 Dinh-Ngoc ..... B24B 53/017 451/56
8,905,823 B2 * 12/2014 Wu ..... B24D 18/00 451/443
2002/0072312 A1 * 6/2002 Park ..... H01L 21/67046 451/56

(Continued)

*Primary Examiner* — Allan W. Olsen
(74) *Attorney, Agent, or Firm* — WPAT, P.C., Intellectual Property Attorneys; Anthony King

(57) ABSTRACT

An apparatus for chemically mechanically polishing includes an arm configured to move a conditioner module. The conditioner module is configured to contact a pad so as to change a degree of roughness of the pad. The pad is configured to contact and polish a semiconductor wafer. The arm has a first end and a second end opposite to the first end. The first end has an electromagnetic module. The conditioner module is detachably magnetically coupled to the arm by means of the electromagnetic module. The second end is coupled to a knob and configured to pivot at the knob. The arm moves the conditioner module through the pivoting of the second end at the knob. The conditioner module is disconnected from the arm when a magnetic polarity at the electromagnetic module is changed.

20 Claims, 7 Drawing Sheets

(56) References Cited

U.S. PATENT DOCUMENTS

2003/0064595 A1* 4/2003 Wang ..... B08B 3/12
438/692
2003/0073391 A1* 4/2003 Janzen ..... B24B 53/017
451/56
2003/0186627 A1* 10/2003 So ..... B24B 53/017
451/56
2004/0072499 A1* 4/2004 Wakabayashi .... H01L 21/67161
451/65
2007/0010172 A1* 1/2007 Benner ..... B24B 53/017
451/11
2008/0311834 A1* 12/2008 Lafon ..... B24B 49/18
451/444
2010/0099342 A1* 4/2010 Chen ..... B24B 53/017
451/494
2010/0248595 A1* 9/2010 Dinh-Ngoc ..... B24B 53/017
451/56
2011/0097977 A1* 4/2011 Bubnick ..... B24B 53/017
451/56
2013/0316630 A1* 11/2013 Rothenberg ..... B24B 53/017
451/443
2015/0357199 A1* 12/2015 Kramer ..... B24B 57/02
438/692

* cited by examiner

APPARATUS AND METHOD FOR CHEMICALLY MECHANICALLY POLISHING

PRIORITY CLAIM AND CROSS-REFERENCE

This patent is a divisional application of U.S. patent application Ser. No. 14/101,962 filed on Dec. 10, 2013, entitled of "APPARATUS AND METHOD FOR CHEMICALLY MECHANICALLY POLISHING", which is incorporated by reference in its entirety.

BACKGROUND

The semiconductor integrated circuit (IC) industry has experienced rapid growth. Between and during operation processes of manufacturing semiconductor wafers, chemical mechanical polishing (CMP) process has been used to remove unwanted material from semiconductor wafer surfaces.

A CMP tool includes a pad for polishing the semiconductor wafer. The pad and the semiconductor wafer are both rotated when in contact with each other. The roughness of the surface of the pad, the rotation speeds of the semiconductor wafer and the pad, and the relative pressure between the semiconductor wafer and the pad are factors that affect the polishing result, i.e., the planarization of the semiconductor wafer.

During the CMP process, the pad itself becomes smoother from the polishing. Therefore, it is necessary to have a reconditioning process to recreate the rough pad surface. CMP tools have pad conditioners to recondition the pads. The conditioner resurfaces the pad, removes the used slurry, and supplies the pad surface with fresh slurry. Ways to improve conditioners so as to maintain consistent pad condition and wafer-to-wafer process uniformity are continuingly being sought.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

Like reference symbols in the various drawings indicate like elements.

DETAILED DESCRIPTION

Figure 1A:
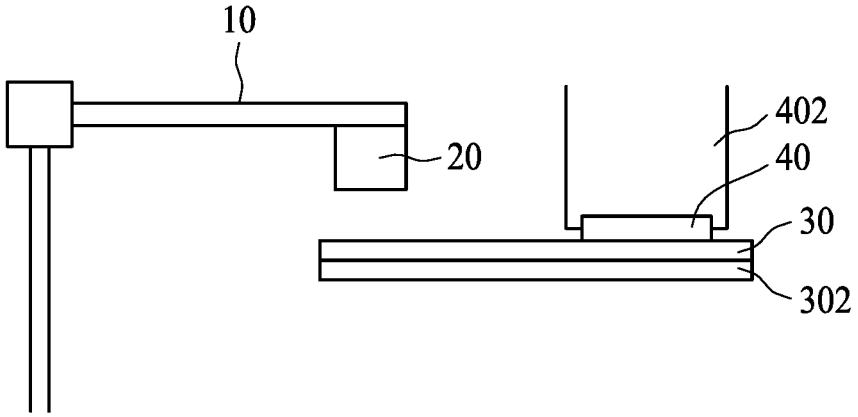
FIGS. 1A-1C are different perspective views of a semiconductor wafer chemical mechanical polishing apparatus in accordance with some embodiments of the present disclosure.

It is understood that the following disclosure provides many different embodiments, or examples, for implementing different features of the disclosure. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. It will be understood that when an element is referred to as being "connected to" or "coupled to" another element, it may be directly connected to or coupled to the other element, or intervening elements may be present.

Semiconductor Wafer Chemical Mechanical Polishing Apparatus

Figure 1B:
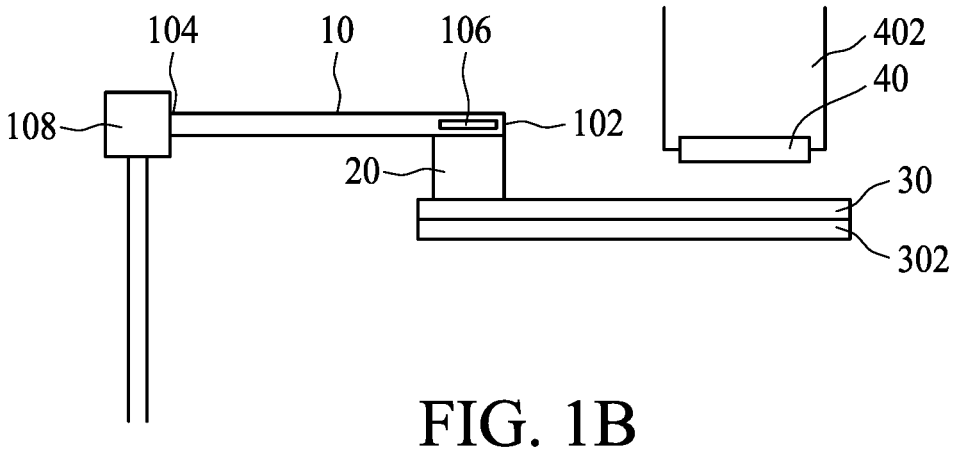
Figure 1C:
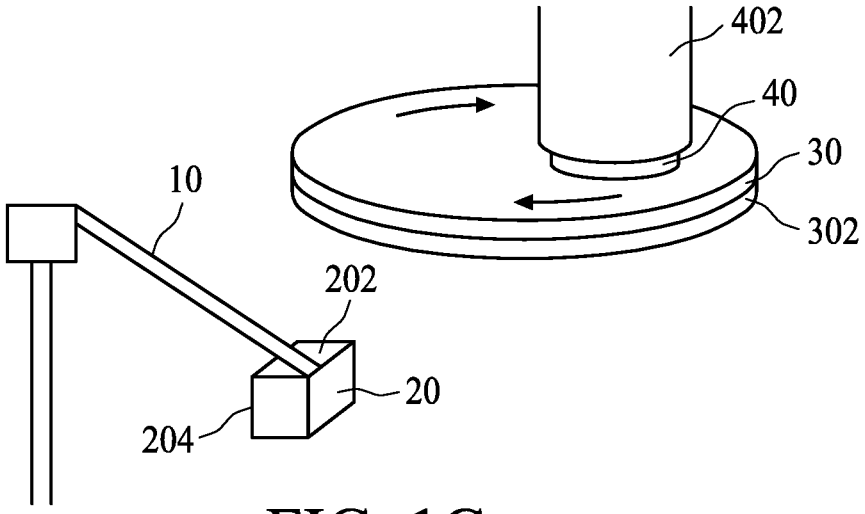

FIGS. 1A-1C are different perspective views of a semiconductor wafer chemical mechanical polishing apparatus in accordance with some embodiments of the present disclosure.

FIG. 1A is a side-view of the semiconductor wafer chemical mechanical polishing apparatus in accordance with some embodiments of the present disclosure. A pad 30 mounted on a revolving module 302 is provided. The pad 30 is made of a durable, reproducible and/or compressible material, such as porous, polymer, polyurethane, polyester, or combinations thereof. Pad made of other materials are within the contemplated scope of the present disclosure. The revolving module 302 is configured to rotate the pad 30. In addition, a semiconductor wafer 40 is provided. A carrier 402 is configured to hold the semiconductor wafer 40 and contact the semiconductor wafer 40 with the rotating pad 30. The carrier 402 may apply a downward force to the semiconductor wafer 40 against the rotating pad 30. Accordingly, the surface of the semiconductor wafer 40 is polished. In certain embodiments, chemical slurries (not depicted) are provided to the pad 30 when polishing the semiconductor wafer 40. The combined effect of mechanical abrasion and chemical etch removes material from the surface of the semiconductor wafer 40. Overtime, a degree of roughness of the surface of the pad 30 is lowered due to polishing, and the polishing result of the semiconductor wafer 40 becomes less uniform. Therefore, reconditioning, i.e., changing the degree of roughness of, the pad 30 is desired.

Referring to FIG. 1A, the semiconductor wafer chemical mechanical polishing apparatus has an arm 10. The arm 10 is configured to be coupled to a conditioner module 20. The conditioner module 20 is configured to change the degree of roughness of the pad 30. The surface of the conditioner module 20 is coarse. Alternatively, the conditioner module 20 may be equipped with a coarse disk (not depicted) at its surface. Accordingly, when the conditioner module 20 contacts the rotating pad 30, the friction between the conditioner module 20 and the pad 30 serves to adjust the degree of roughness, i.e., resurface, the pad 30. In some embodiments, the conditioner module 20 serves to remove the used slurry from the pad 30. Detailed technical features of the conditioner module 20 will be introduced later with reference to FIG. 1B.

FIG. 1B is a side-view of the semiconductor wafer chemical mechanical polishing apparatus in accordance with some embodiments of the present disclosure. The arm 10 includes a first end 102 and a second end 104 opposite to the first end 102. The arm 10 is equipped with an electromagnetic module 106 at the first end 102. The electromagnetic module 106 is configured to detachably magnetically secure the conditioner module 20 to the first end 102 of the arm 10. The second end 104 is pivotally connected to a knob 108. The arm 10 pivots, through the second end 104, at the knob 108 so as to move the conditioner module 20. For example, the arm 10 is configured to move the magnetically coupled conditioner module 20 to a position where the conditioner module 20 is in contact with the pad 30. As the pad 30 is rotated by the revolving module 302, the coarse surface of the conditioner module 20 serves to change the degree of roughness of, i.e., recondition, the surface of the pad 30. The arm 10 may apply a force to the conditioner module 20 against the pad 30 to increase the efficiency or degree of reconditioning. Accordingly, the roughness of the surface of the pad 30 is adjusted and maintained. During the reconditioning of the pad 30, the carrier 402 is configured to remove the semiconductor wafer 40 away from the pad 30.

In some embodiments, the surface of the conditioner module 20 includes particles of rigidness higher than or equal to that of the pad 30. For example, the particles are diamond pellets. Alternatively, a disk (not depicted) having particles is attached to the surface of the conditioner module 20. Accordingly, the abrasion of the particles on the conditioner module 20 against the pad 30 serves to scrape the surface of the pad 30. The pad 30 is usually reconditioned by the conditioner module 20 for a period of time. Overtime, the surface of the conditioner module 20 will be worn out due to continuous reconditioning. Therefore, it is desirable to restore the conditioner module 20 to its previous state, i.e., the state previous to the reconditioning of the pad 30. Alternatively, a new conditioner module 20 needs to replace the old one.

FIG. 1C is a side-view of the semiconductor wafer chemical mechanical polishing apparatus in accordance with some embodiments of the present disclosure. The semiconductor wafer 40 is configured to contact the pad 30, which is rotated by the revolving module 302. In certain embodiments, the semiconductor wafer 40 is rotated by the carrier 402 in a direction opposite to the pad 30. For example, the semiconductor wafer 40 is rotated clockwise while the pad 30 is rotated counter-clockwise. When the pad 30 contacts the semiconductor wafer 40, the conditioner module 20 is removed from the pad 30 and does not contact the pad 30. The conditioner module 20 may be disconnected from the arm 10 so as to be further treated, e.g., cleaned. In some embodiments, the conditioner module 20 is configured to remain in contact with the pad 30 when the pad 30 is in contact with the semiconductor wafer 40. That is, the conditioner module 20 is configured to recondition the pad 30 while the pad 30 polishes the semiconductor wafer 40.

Referring to FIG. 1C, the conditioner module 20 is a substantially polyhedral and has six surfaces. A first surface 202 is configured to contact the arm 10 when the conditioner module 20 is magnetically coupled to the arm 10. Accordingly, when the conditioner module 20 is in contact with the pad 30 (not depicted), a surface opposite to the first surface 202 is in contact with and serves to recondition the pad 30. Alternatively, the conditioner module 20 may be coupled to the arm 10 through a second surface 204. Therefore, the conditioner module 20 may be configured to recondition the pad 30 by a surface opposite to the second surface 204. In other words, the surface now configured to recondition the pad 30 is different from the surface opposite to the first surface 202. The features of the rotation of the conditioner module 20 will be introduced later.

Figure 2A:
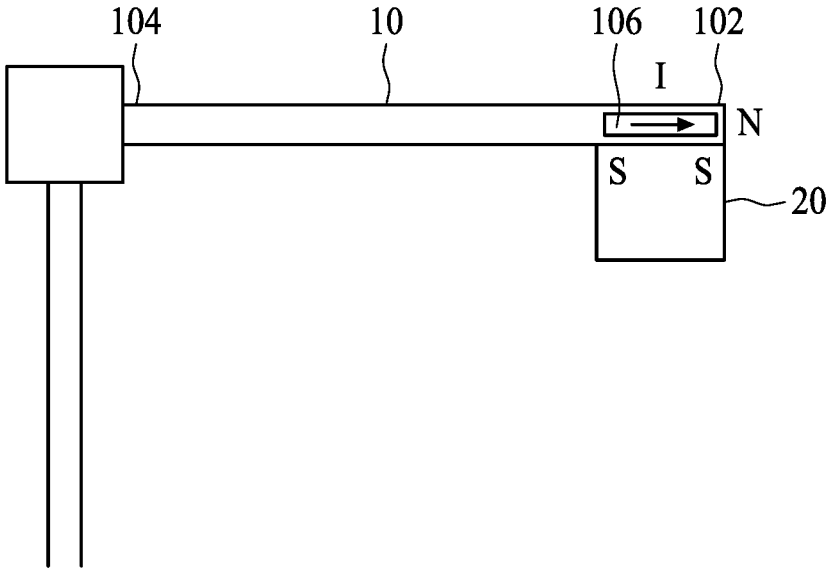
FIGS. 2A and 2B are different perspective views of a semiconductor wafer chemical mechanical polishing apparatus in accordance with some embodiments of the present disclosure.
Figure 2B:
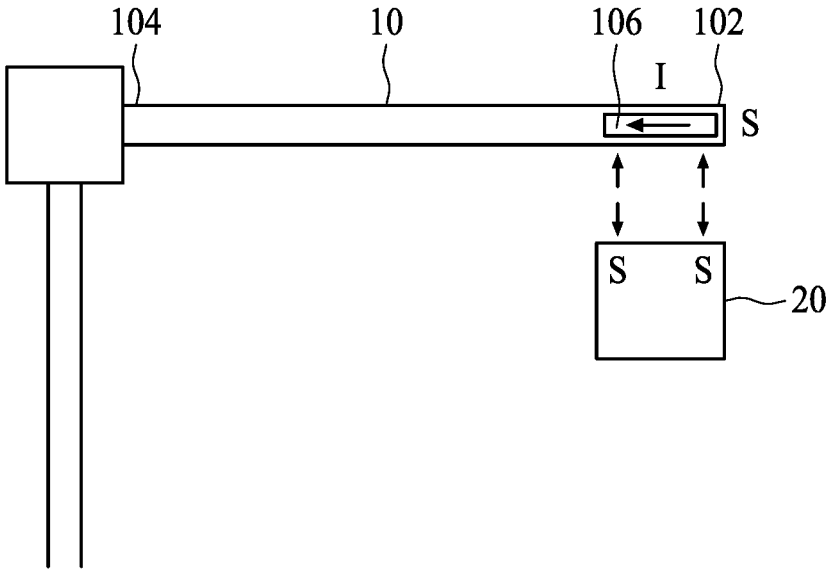

FIGS. 2A and 2B are different perspective views of a semiconductor wafer chemical mechanical polishing apparatus in accordance with some embodiments of the present disclosure.

FIG. 2A is a side-view of the semiconductor wafer chemical mechanical polishing apparatus in accordance with some embodiments of the present disclosure. At the electromagnetic module 106, an electrical current (represented with symbol "I" in the description hereinafter) flows in the direction from the second end 104 to the first end 102 of the arm 10. According to the Ampere's circuital law, a north magnetic polarity is created at the arm 10. In addition, a surface of the conditioner module 20 has a magnetic unit (not depicted) that possesses the south magnetic polarity. As a result, the conditioner module 20 is magnetically coupled to the arm 10 due to magnetic attraction. The arm 10 then moves the conditioner module 20 to contact the pad (not depicted) by pivoting at the second end 104.

FIG. 2B is a side-view of the semiconductor wafer chemical mechanical polishing apparatus in accordance with some embodiments of the present disclosure. At the electromagnetic module 106, an electrical current I flows in the direction from the first end 102 to the second end 104 of the arm 10. According to the Ampere's circuital law, a south magnetic polarity is created at the arm 10. Because the surface of the conditioner module 20 has a magnetic unit (not depicted) that possesses south magnetic polarity, the conditioner module 20 is magnetically repulsed and disconnected from the arm 10. In other words, the conditioner module 20 is disconnected from the arm 10 when a magnetic polarity at the electromagnetic module 106 is changed. The disconnected conditioner module may be further cleaned or replaced as desired.

In some embodiments in accordance with the present disclosure, the magnetic unit at the surface of the conditioner module 20 possesses north magnetic polarity. Thus, the conditioner module 20 is magnetically coupled to the arm 10 when a current I flows in the direction from the first end 102 to the second end 104 of the arm 10 at the electromagnetic module 106.

FIGS. 3A-3E are different perspective views of a semiconductor wafer chemical mechanical polishing apparatus in accordance with some embodiments of the present disclosure.

Figure 3A:
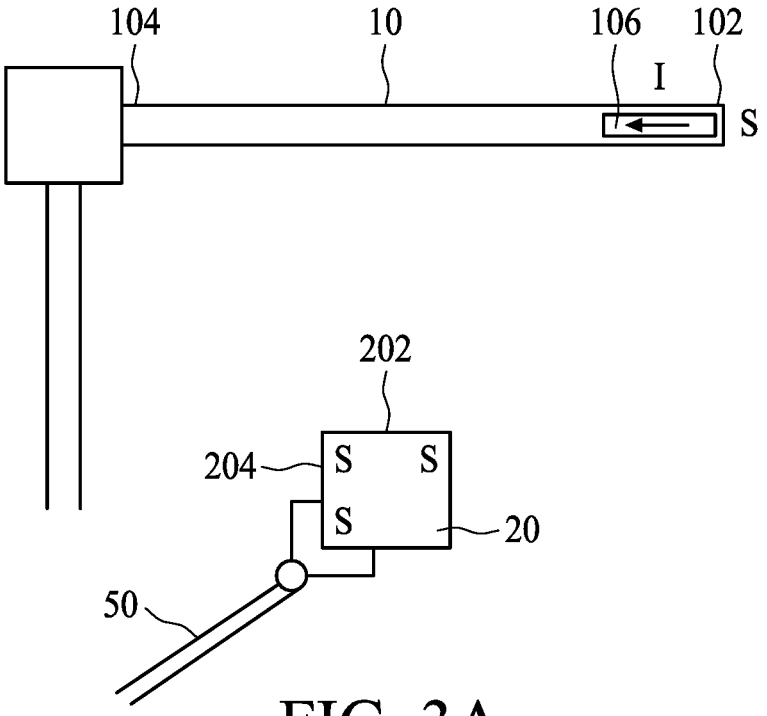
FIGS. 3A-3E are different perspective views of a semiconductor wafer chemical mechanical polishing apparatus in accordance with some embodiments of the present disclosure.
Figure 3B:
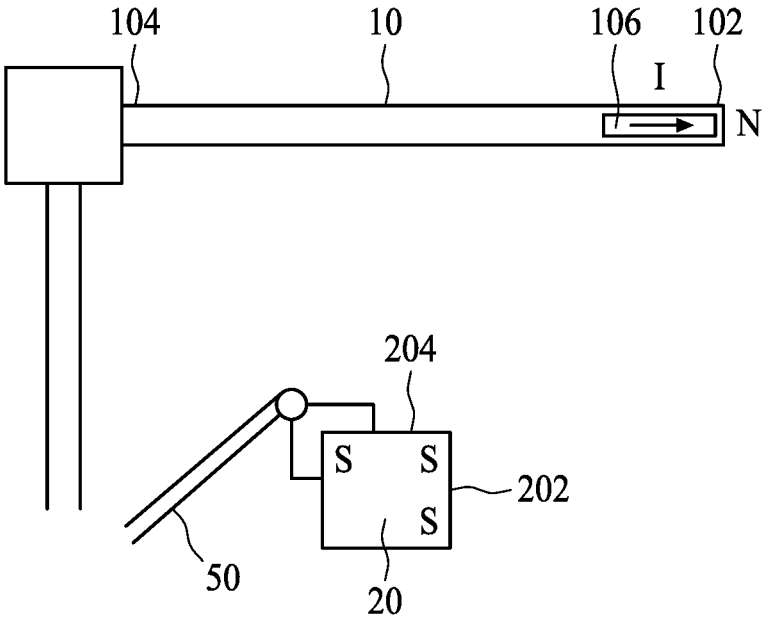

FIGS. 3A-3B are side-views of the semiconductor wafer chemical mechanical polishing apparatus in accordance with some embodiments of the present disclosure. Referring to FIG. 3A, the conditioner module 20 is disconnected from the arm 10 due to a change of magnetic polarity at the electromagnetic module 106. Here, the magnetic polarity of the conditioner module 20 at the first surface 202 is south, and the magnetic polarity of the electromagnetic module 106 is south. Thus, the conditioner module 20 is disconnected from the arm 10 due to magnetic repulsion. A rotation module 50 is configured to receive the conditioner module 20 from the arm 10. Thereafter, with reference to FIG. 3B, the rotation module 50 is configured to rotate the conditioner module 20 for about 90 degrees such that the second surface 204 now faces the arm 10. In addition, the electrical current I now flows in the direction from the second end 104 to the first end 102, thus creating a north magnetic polarity at the electromagnetic module 106. The conditioner module 20 is now ready to be magnetically coupled to the arm 10 at the second surface 204 by means of the magnetic attraction. In other words, before the conditioner module 20 is rotated by the rotation module 50, the conditioner module 20 is configured to contact the pad (not depicted) at a surface opposite to the first surface 202. After the conditioner module 20 is rotated by the rotation module 50 and reconnected to the arm 10, a surface opposite to the second surface 204 of the conditioner module 20 is now ready to contact the pad. Consequently, a new surface of the conditioner module 20 replaces the old surface, which is worn due to reconditioning of the pad. Therefore, multiple surfaces of one conditioner module 20, through rotation, can be utilized to recondition the pad.

In some embodiments in accordance with the present disclosure, the arm 10 is configured to cooperate with the rotation module 50 to rotate the conditioner module 20. For example, the arm 10 is configured as a point of support while the rotation module 50 is configured to apply a force to the conditioner module 20 so as to tilt and rotate the conditioner module 20.

A mechanism is applied to determine whether and when the conditioner module should be removed from the arm and rotated by the rotation module. In some embodiments, a timer is used to calculate the duration that the conditioner module reconditions the surface of the pad. As the surface of the conditioner module becomes smoother overtime due to the reconditioning of the pad, statistics of worn out lifetime of conditioner module surface can be gathered. When a worn out lifetime of a conditioner module surface is reached, the conditioner module is removed from the arm and rotated. Accordingly, a new conditioner module surface can be used to adjust the degree of roughness of the pad so as to maintain the uniformity of the polishing result of the semiconductor wafer. In certain embodiments, a monitoring device is used to examine the surface condition of the pad or the semiconductor wafer. The monitoring device may be an electronic microscope designed to tell the condition of the pad surface or semiconductor wafer surface. When the monitoring device discerns that the surface condition has changed or reached a specific state, a message will be sent as a reminder to rotate and apply a different conditioner module surface to the pad.

Figure 3C:
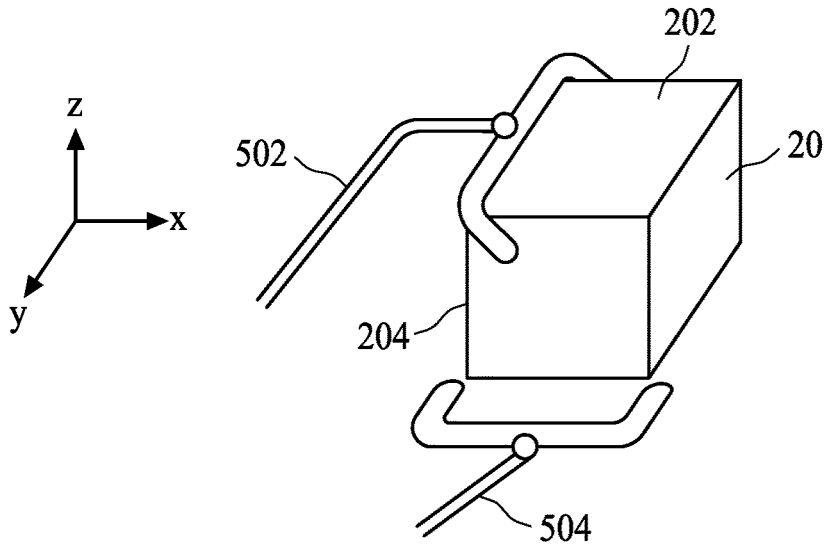
Figure 3D:
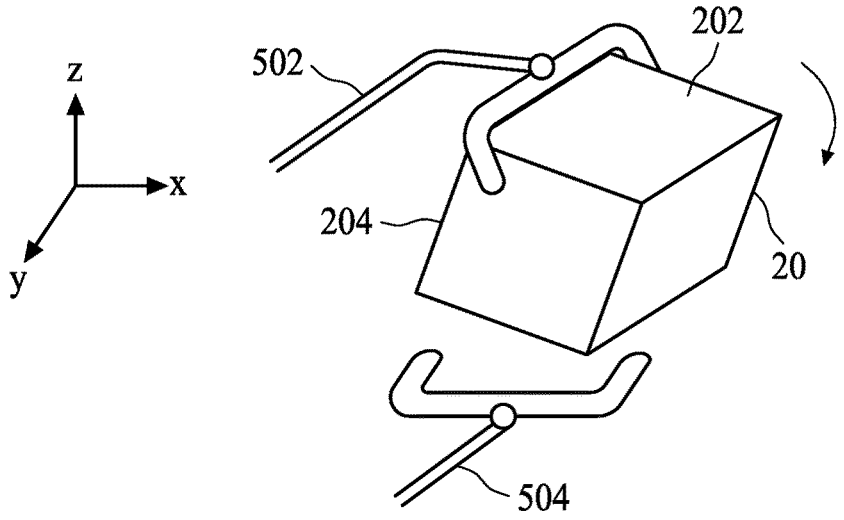
Figure 3E:
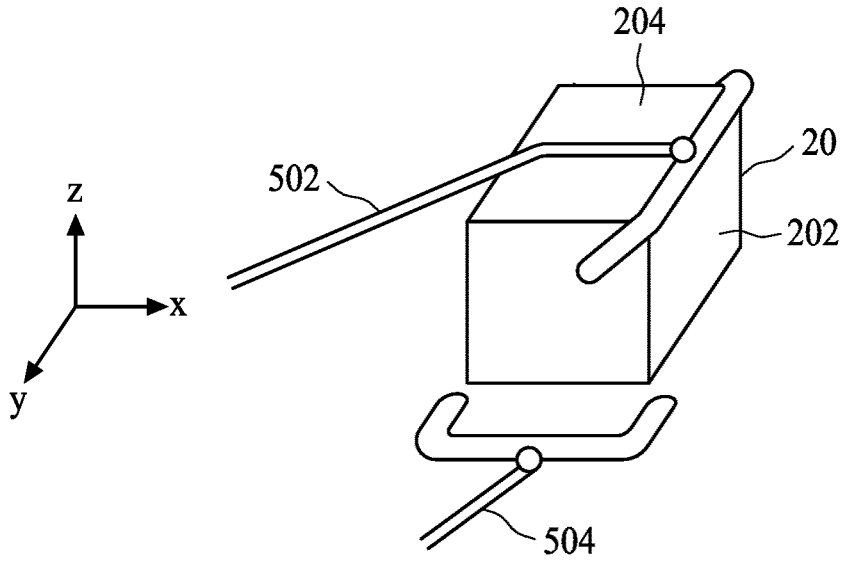

FIGS. 3C-3E are side-views of the semiconductor wafer chemical mechanical polishing apparatus in accordance with some embodiments of the present disclosure. Referring to FIG. 3C, the rotation module 50 has a first lever 502 and a second lever 504. The first lever 502 is configured to rotate the conditioner module 20 around a first axis, and the second lever 504 is configured to rotate the conditioner module 20 around a second axis. In certain embodiments, the first axis is substantially perpendicular to the second axis. For example, the first lever 502 is configured to rotate the conditioner module 20 around the y-axis, and the second lever 504 is configured to rotate the conditioner module 20 around the x-axis.

Referring to FIG. 3C, the conditioner module 20 is disconnected from the arm (not depicted) from the first surface 202. The first lever 502 is configured to clamp the conditioner module 20. The second lever 504 may cooperate with the first lever 502 to rotate the conditioner module 20. In some embodiments, the second lever 504 is configured as a point of support to help tilt the conditioner module 20 (not depicted). Referring to FIG. 3D, the first lever 502 is configured to tilt the conditioner module 20 while still clamping the conditioner module 20. Referring to FIG. 3E, the conditioner module 20 has been rotated for about 90 degrees by the first lever 502. In other words, the first surface 202 of the conditioner module 20 was substantially parallel with a plane formed by the x-axis and the y-axis (FIG. 3C). After the conditioner module 20 is rotated by the first lever 502, the first surface 202 of the conditioner module 20 is substantially parallel with a plane formed by the y-axis and the z-axis (FIG. 3E). The conditioner module 20 is rotated for about 90 degrees around the y-axis. Consequently, the conditioner module 20 is now ready to be magnetically coupled to the arm 10 at the second surface 204. Thus a new surface of the conditioner module 20 is now ready to recondition the pad (not depicted).

In some embodiments in accordance to the present disclosure, the first lever 502 and the second lever 504 are configured to rotate the conditioner module 20 around different axes for different degrees as desired. In some examples, the conditioner module 20 is rotated around the x-axis for about 180 degrees so as to rotate the conditioner module 20 upside down. In certain examples, the conditioner module 20 is substantially hexahedral, and is rotated for about 60 degrees, 120 degrees, 180 degrees, 240 degrees, 300 degrees or 360 degrees. The rotation by the first lever 502 and/or the second lever 504 renders every surface of the conditioner module 20, whatever shape it is, to be utilized to contact, i.e., recondition, the pad. It is to be noted that lever of other types, shapes, sizes, or functional features is within the contemplated scope of the present disclosure.

Figure 4:
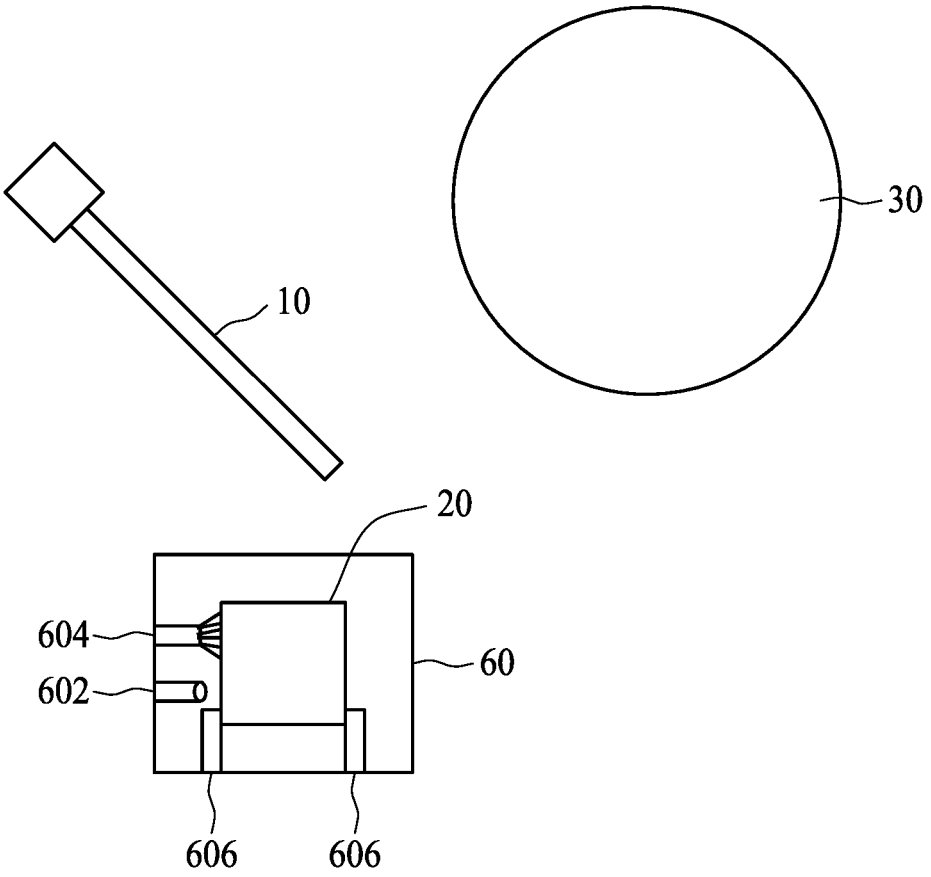
FIG. 4 is a top-view of the semiconductor wafer chemical mechanical polishing apparatus in accordance with some embodiments of the present disclosure.

FIG. 4 is a top-view of the semiconductor wafer chemical mechanical polishing apparatus in accordance with some embodiments of the present disclosure. The apparatus has a cleansing module 60 configured to clean the conditioner module 20. The arm 10 is configured to move the conditioner module 20 from the pad 30 to the cleansing module 60. In certain embodiments, the arm 10 is configured to first move the conditioner module 20 to a rotation module (not depicted) for rotation, and then move the conditioner module 20 to the cleansing module 60. In some embodiments, the conditioner module 60 itself is configured to rotate the conditioner module 20. It includes a rotation module, which is referred to any aforementioned embodiment. Therefore the rotation module may be removed from the semiconductor wafer chemical mechanical polishing apparatus.

In some embodiments in accordance with the present disclosure, the cleansing module 60 has a dispenser 602 configured to provide a cleaning agent to the conditioner module 20. The cleaning agent includes distilled water, chemicals or combinations thereof. In certain embodiments, the dispenser 602 is a nozzle configured to spray the cleaning agent to the conditioner module 20. Dispenser of other types is within the contemplated scope of the present disclosure.

In some embodiments in accordance with the present disclosure, the cleansing module 60 has a brush 604 configured to clean the conditioner module 20. The brush 604 is configured to remove unwanted material, residue, cleaning agent or slurry from the surface of the conditioner module 20. The brush 604 is made of soft materials like polypropylene (PP), nylon, etc. Brush made of other materials is within the contemplated scope of the present disclosure.

In some embodiments in accordance with the present disclosure, the cleansing module 60 has a chuck 606 configured to secure the conditioner module 20. After the cleansing module 60 receives the conditioner module 20 from the arm 10, the chuck 606 is configured to maintain the conditioner module 20 at a fixed position while being cleaned. In certain embodiments, the chuck 606 is configured to clamp the conditioner module 20. Chuck of other types is within the contemplated scope of the present disclosure.

In some embodiments in accordance with the present disclosure, the cleansing module 60 has a conveyer (not depicted) configured to receive the conditioner module 20 at the arm 10. The conveyer is further configured to deliver the conditioner module 20 from the arm 10 to the cleansing module 60. In certain embodiments, the cleansing module 60 is equipped with a revolving module (not depicted) configured to rotate the conditioner module 20 at the cleansing module 60.

Figure 5:
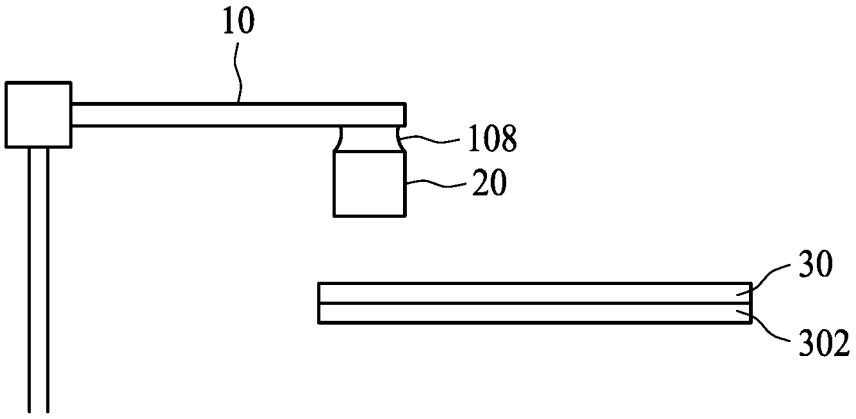
FIG. 5 is a side-view of the semiconductor wafer chemical mechanical polishing apparatus in accordance with some embodiments of the present disclosure.

FIG. 5 is a side-view of the semiconductor wafer chemical mechanical polishing apparatus in accordance with some embodiments of the present disclosure. The arm 10 is equipped with a vacuum chuck 108 configured to secure the conditioner module 20 to the arm 10 by suction. The conditioner module 20 can then be moved by the arm 10 to contact the pad 30. The vacuum chuck 108 is configured to continue vacuuming the conditioner module 20 while the conditioner module 20 is in contact with the pad 30. In certain embodiments, the vacuum chuck 108 is configured to rotate the conditioner module 20 by vacuuming the conditioner module 20. In some embodiments, the vacuum chuck 108 is configured to clean the conditioner module 20 by vacuuming the surface of the conditioner module 20.

Semiconductor Wafer Manufacturing Apparatus

Figure 6A:
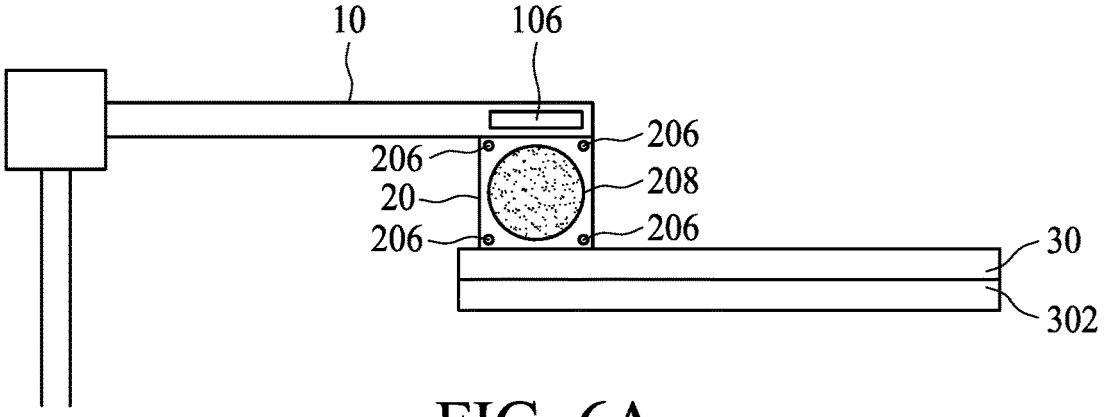
FIGS. 6A-6C are different perspective views of a semiconductor wafer manufacturing apparatus in accordance with some embodiments of the present disclosure.
Figure 6B:
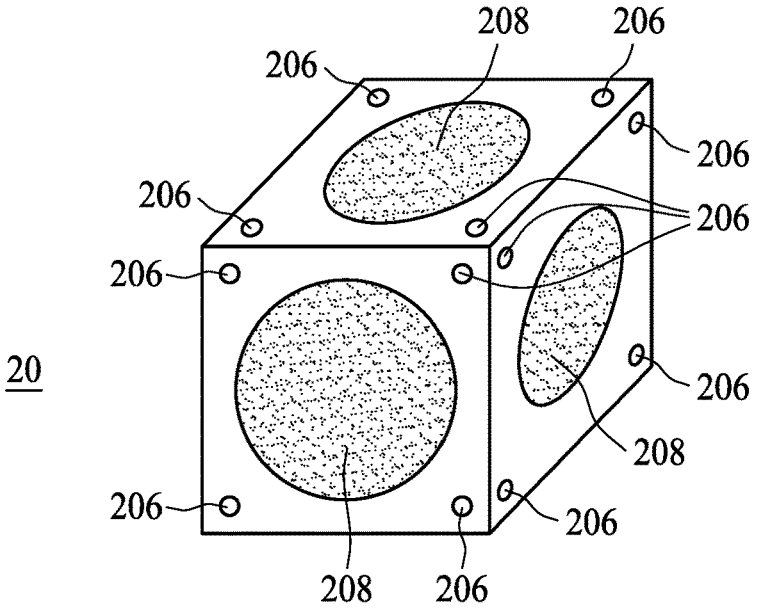
Figure 6C:
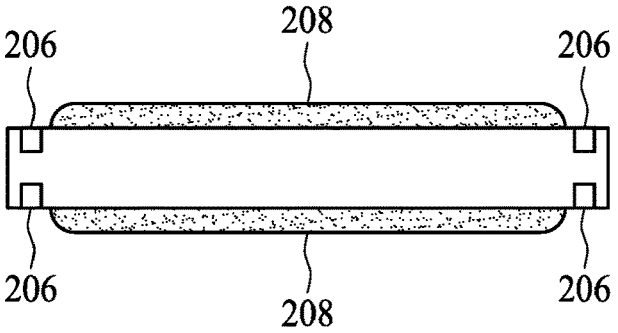

FIGS. 6A-6C are different perspective views of a semiconductor wafer manufacturing apparatus in accordance with some embodiments of the present disclosure.

FIG. 6A is a side-view of the semiconductor wafer manufacturing apparatus in a semiconductor wafer chemical mechanical polishing tool in accordance with some embodiments of the present disclosure. The semiconductor wafer chemical mechanical polishing tool (not depicted) has an arm 10. The conditioner module 20 is magnetically coupled to the arm 10 by means of the electromagnetic module 106. The arm 10 is configured to push the conditioner module 20 against a pad 30 in the semiconductor wafer chemical mechanical polishing tool. The conditioner module 20 serves to change the degree of roughness of the pad 30. The pad 30 is rotated by the revolving module 302 and configured to polish a semiconductor wafer (not depicted) in the semiconductor wafer chemical mechanical polishing tool.

Referring to FIG. 6A, the surface of the conditioner module 20 is equipped with a magnetic unit 206. The conditioner module 20 is configured to be coupled to the arm 10 by the magnetic attraction between the magnetic unit 206 and the electromagnetic module 106. In some embodiments, the conditioner module 20 is equipped with more than one magnetic unit 206 at the peripherals of the surfaces of the conditioner module 20. In certain embodiments, each surface of the conditioner module 20 is equipped with one or more magnetic units 206. Alternatively, the entire or a portion of the surface of the conditioner module 20 is magnetic so as to magnetically couple the conditioner module 20 to the arm.

Referring to FIG. 6A, the surface of the conditioner module 20 is equipped with a disk 208. The disk 208 is configured to change the degree of roughness of the pad 30. In some embodiments, the disk 208 is secured to the surface of the conditioner module 20 by a screw. In certain embodiments, the disk 208 is magnetically attracted and detachably coupled to the surface of the conditioner module 20.

In some embodiments in accordance with the present disclosure, at least two surfaces of the conditioner module 20 are equipped with disks 208. Each disk has a substantially same worn out lifetime. For example, the conditioner module 20 was configured to contact the pad 30 with an initial disk. The conditioner module 20 is rotated after the conditioner module 20 finishes conditioning the pad 30 and is removed from the pad 30. The arm 10 recaptures the rotated conditioner module 20 at a different surface. Now, a disk different from the initial disk is faced against the pad 30. The arm 10 then moves the conditioner module 20 to contact the pad 30 with the disk different from the initial disk. Accordingly, disks 208 at different surfaces of a same conditioner module 20 are configured to contact and change the degree of roughness of the pad 30.

FIG. 6B is a side-view of the semiconductor wafer manufacturing apparatus in a semiconductor wafer chemical mechanical polishing tool in accordance with some embodiments of the present disclosure. The conditioner module 20 is substantially a cube and has six surfaces. Every surface of the conditioner module 20 is equipped with a disk 208 respectively. In addition, every surface of the conditioner module 20 is equipped with one or more magnetic units 206. Accordingly, all six surfaces of the conditioner module 20 can be configured to be detachably magnetically coupled to the arm (not depicted). Moreover, the disks 208 at all six surfaces of the conditioner module 20 can be configured to contact the pad (not depicted) to change the degree of roughness of the pad.

FIG. 6C is a side-view of the semiconductor wafer manufacturing apparatus in a semiconductor wafer chemical mechanical polishing tool in accordance with some embodiments of the present disclosure. The conditioner module 20 is substantially a plate having two elongated surfaces. The two elongated surfaces of the conditioner module 20 are equipped with disks 208 and magnetic units 206. Accordingly, the disk 208 of each of the elongated surfaces of the conditioner module 20 is configured to contact the surface of the pad (not depicted). In addition, the conditioner module 20 may be magnetically connected to the arm (not depicted) by means of the magnetic units 206 of each of the elongated surfaces of the conditioner module 20.

In some embodiments in accordance with the present disclosure, the shape of the conditioner module 20 includes triangular pyramid, tetrahedron, cube, hexahedron, octahedron, dodecahedron and icosahedron. At least two surfaces of the conditioner module 20 are configured to be detachably coupled with a disk 208 and/or a magnetic unit 206. Conditioner module of other shapes is within the contemplated scope of the present disclosure.

Figure 7:
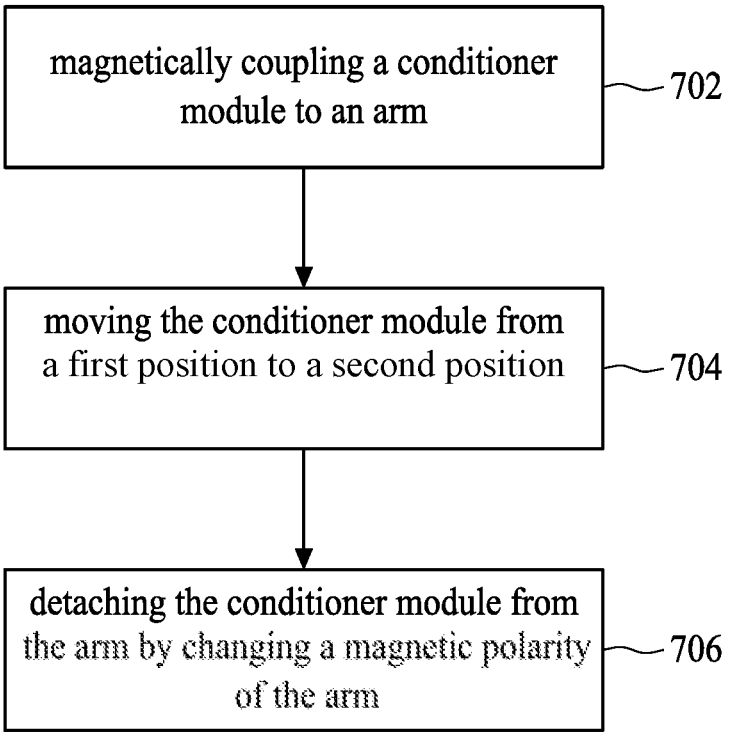
FIG. 7 is a method of configuring a conditioner module in a semiconductor wafer chemical mechanical polishing tool in accordance with some embodiments of the present disclosure.

Method to Configure a Conditioner Module in a Semiconductor Wafer Chemical Mechanical Polishing Tool FIG. 7 is a method of configuring a conditioner module in a semiconductor wafer chemical mechanical polishing tool in accordance with some embodiments of the present disclosure.

Referring to FIG. 7, in operation 702, a conditioner module is magnetically coupled to an arm. The arm is configured to contact the conditioner module with a pad in a chemical mechanical polishing tool. The chemical mechanical polishing tool further has a revolving module for rotating the pad. The conditioner module serves to change a degree of roughness of the pad when the pad rotates. The rotating pad serves to polish the surface of a semiconductor wafer in the chemical mechanical polishing tool when the semiconductor wafer is pressed against the pad. In addition, the arm has an electromagnetic module configured to detachably magnetically couple the conditioner module to the arm. Based on the direction of the electrical current at the electromagnetic module, different magnetic polarities can be created at the electromagnetic module. The conditioner module has more than two surfaces respectively equipped with a disk and a magnetic unit. When the magnetic polarity of the electromagnetic module and the conditioner module is different, the conditioner module is magnetically coupled to the arm.

In operation 704, the arm moves the conditioner module from a position away from a pad to a position contacting the pad. One end of the arm is configured to pivot at a knob. In some embodiments, the arm pivots at the knob so as to move the conditioner module from a position contacting the pad to a position away from the pad.

In operation 706, the conditioner module is detached from the arm when a magnetic polarity of the arm is changed. For example, the conditioner module possesses a north magnetic polarity and the arm possesses a south magnetic polarity when the conditioner module is magnetically coupled to the arm. When the magnetic polarity of the arm changes from south to north, a magnetic repulsion is created between the arm and the conditioner module. Accordingly, the conditioner module is detached from the arm. The detached conditioner module may be treated in further operations.

In some embodiments in accordance with the present disclosure, the conditioner module is rotated after the conditioner module is detached from the arm. The conditioner module may be rotated by a rotation module. In certain embodiments, the rotation module cooperates with the arm to rotate the conditioner module. In some embodiments, the rotation module has a first lever and a second lever configured to rotate the conditioner module around different axes. A mechanism is provide to determine when and whether to rotate the conditioner module. For example, the conditioner module is to be rotated when the degree of roughness of the pad surface is decreased to a certain level.

In some embodiments in accordance with the present disclosure, after the conditioner module is rotated, the conditioner module is reconnected to the arm. Specifically, the conditioner module is configured to be magnetically coupled to the arm at a surface different than that before the conditioner module is rotated. In other words, a different surface of the conditioner module, which possesses a desirable coarseness, is configured to contact the pad and change the degree of roughness of the pad. The reconditioned pad serves to deliver a more uniform polishing result of the semiconductor wafer.

In some embodiments in accordance with the present disclosure, a disk is magnetically coupled to the conditioner module. More than one disk may be coupled to the surfaces of the conditioner module. The surface of the disk is coarse. Accordingly, the disk serves the same function as the surface of the conditioner module, i.e., to change the degree of roughness of the pad. The application of the disk renders a longer lifetime for the body of the conditioner module. For example, instead of replacing the entire conditioner module with a new one when all the surfaces are worn out, the disks on each surface may be replaced. Accordingly, the lifetime of the conditioner module is extended.

An apparatus for chemically mechanically polishing semiconductor wafer is provided. The apparatus has an arm. The arm has a first end and a second end opposite to the first end. An electromagnetic module is disposed at the first end. A conditioner module is configured to detachably couple to the arm by means of the electromagnetic module. The second end is configured to connect to and pivot at a knob. The pivoting of the second end at the knob renders the arm to move the conditioner module so as to contact a pad. The conditioner module is configured to change a degree of roughness of the pad when in contact with the pad. The pad is configured to contact a semiconductor wafer so as to polish the semiconductor wafer.

An apparatus for chemically mechanically polishing semiconductor wafer includes a rotation module configured to rotate the conditioner module. In certain embodiments, the rotation module is configured to cooperate with the arm to rotate the conditioner module.

An apparatus for chemically mechanically polishing semiconductor wafer includes a rotation module having a first lever and a second lever to rotate the conditioner module around different axes.

An apparatus for chemically mechanically polishing semiconductor wafer includes a cleansing module to clean the conditioner module. The cleansing module includes a dispenser to provide a cleaning agent to the conditioner module, a brush to clean the conditioner module, and/or a chuck to secure the conditioner module at the cleansing module.

A semiconductor wafer manufacturing apparatus is provided. The apparatus has a conditioner module having a magnetic unit. A disk is configured to be coupled to the conditioner module. The conditioner module is configured to be detachably coupled to a semiconductor wafer chemical mechanical polishing tool through the magnetic unit. The disk is configured to contact a pad in the semiconductor wafer chemical mechanical polishing tool so as to change a degree of roughness of the pad. The pad is configured to contact a semiconductor wafer in the semiconductor wafer chemical mechanical polishing tool so as to polish the semiconductor wafer.

A semiconductor wafer manufacturing apparatus includes a conditioner module having a magnetic unit at the peripheral of the surface of the conditioner module.

A semiconductor wafer manufacturing apparatus includes a substantially polyhedral conditioner module.

A method of configuring a conditioner module in a semiconductor wafer chemical mechanical polishing tool includes magnetically coupling a conditioner module to an arm and moving the conditioner module from a first position to a second position by the arm. The method further includes detaching the conditioner module from the arm by changing a magnetic polarity of the arm.

In some embodiments, the method of configuring a conditioner module in a semiconductor wafer chemical mechanical polishing tool includes rotating the conditioner module.

In some embodiments, the method of configuring a conditioner module in a semiconductor wafer chemical mechanical polishing tool includes magnetically coupling the conditioner module to the arm at a different surface of the conditioner module.

In some embodiments, the method of configuring a conditioner module in a semiconductor wafer chemical mechanical polishing tool includes magnetically coupling a disk to the conditioner module.

Although the present invention and its advantages have been described in detail, it should be understood that various changes, substitutions and alterations cancan be made herein without departing from the spirit and scope of the invention as defined by the appended claims. For example, many of the processes discussed above cancan be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method to configure a conditioner module in a semiconductor wafer chemical mechanical polishing tool, comprising:

providing an arm;

magnetically coupling a first surface of the conditioner to the arm;

detaching the conditioner from the arm by changing a magnetic polarity of the arm;

cooperatively using a first lever and a second lever to rotate the conditioner such that a second surface faces the arm;

magnetically coupling the second surface of the conditioner to the arm; and equipping each of the first surface and the second surface of the conditioner with a disk.

2. The method according to claim 1, wherein the cooperatively using the first lever and the second lever to rotate the conditioner such that the second surface faces the arm further comprises:

clamping the conditioner with the first lever after detaching the conditioner from the arm by changing the magnetic polarity of the arm;

using the second lever to support a point of the conditioner; and using the first lever to tilt the conditioner while the first lever still clamps the conditioner and while the second lever still supports the point of the conditioner such that the second surface faces the arm.

3. The method according to claim 2, wherein the clamping the conditioner with the first lever comprises clamping a third surface and a fourth surface of the conditioner with the first lever.

4. The method according to claim 3, further comprising equipping each of the third surface and the fourth surface of the conditioner with a disk.

5. The method according to claim 1, further comprising:

moving the conditioner to the semiconductor wafer chemical mechanical polishing tool with the first surface of the conditioner facing the arm; and using the conditioner to recondition a pad.

6. The method according to claim 5, further comprising:

moving the conditioner to the semiconductor wafer chemical mechanical polishing tool with the second surface of the conditioner facing the arm; and using the conditioner to recondition the pad.

7. The method according to claim 5, further comprising:

moving the conditioner from the pad to a cleaner; and cleaning the conditioner with the cleaner.

8. The method according to claim 7, wherein the cleaning the conditioner comprises fixing the conditioner on a chuck.

9. The method according to claim 8, wherein the conditioner is clamped by the chuck.

10. The method according to claim 8, wherein the cleaning the conditioner comprises:

spraying a cleaning agent to the conditioner; and brushing the conditioner.

11. The method according to claim 1, wherein the equipping of the first surface and second surface with the disks comprises magnetically coupling the disks to the conditioner.

12. The method according to claim 1, wherein the equipping of the first surface and second surface with the disks comprises coupling the disks to the conditioner with a screw.

13. A method to configure a conditioner module in a semiconductor wafer chemical mechanical polishing tool, comprising:

providing an arm;

providing a conditioner with a plurality of surfaces;

equipping each of the surfaces of the conditioner with a disk;

coupling a first surface of the conditioner to the arm;

reconditioning a pad of the semiconductor wafer chemical mechanical polishing tool with a second surface opposite to the first surface of the conditioner;

detaching the conditioner from the arm;

cooperatively using a first lever and a second lever to rotate the conditioner such that a third surface of the conditioner faces the arm;

coupling the third surface of the conditioner to the arm; and reconditioning the pad of the semiconductor wafer chemical mechanical polishing tool with a fourth surface opposite to the third surface of the conditioner.

14. The method according to claim 13, wherein the cooperatively using the first lever and the second lever to rotate the conditioner such that the third surface faces the arm further comprises:

clamping the conditioner with the first lever after detaching the conditioner from the arm;

using the second lever to support a point of the conditioner; and using the first lever to tilt the conditioner while the first lever still clamps the conditioner and while the second lever still supports the point of the conditioner such that the third surface faces the arm.

15. The method according to claim 13, further comprising:

moving the conditioner from the pad to a cleaner; and cleaning the conditioner with the cleaner.

16. The method according to claim 15, wherein the cleaning the conditioner comprises fixing the conditioner on a chuck.

17. The method according to claim 16, wherein the cleaning the conditioner comprises:

spraying a cleaning agent to the conditioner; and brushing the conditioner.

18. A method to configure a conditioner module in a semiconductor wafer chemical mechanical polishing tool, comprising:

providing an arm;

providing a conditioner with a plurality of surfaces;

equipping each of the surfaces of the conditioner with a disk;

coupling a first surface of the conditioner to the arm;

moving the conditioner to the semiconductor wafer chemical mechanical polishing tool with the arm;

reconditioning a pad of the semiconductor wafer chemical mechanical polishing tool with a second surface opposite to the first surface of the conditioner;

detaching the conditioner from the arm;

cooperatively using a first lever and a second lever to rotate the conditioner such that a third surface of the conditioner faces the arm;

coupling the third surface of the conditioner to the arm;

moving the conditioner from the pad to a cleaner;

detaching the conditioner from the arm and securing the conditioner on a chuck;

cleaning the conditioner with the cleaner;

coupling the third surface of the conditioner to the arm again; and reconditioning the pad of the semiconductor wafer chemical mechanical polishing tool with a fourth surface opposite to the third surface of the conditioner.

19. The method according to claim 18, wherein the cooperatively using the first lever and the second lever to rotate the conditioner such that the third surface faces the arm further comprises:

clamping the conditioner with the first lever after detaching the conditioner from the arm;

using the second lever to support a point of the conditioner; and using the first lever to tilt the conditioner while the first lever still clamps the conditioner and while the second lever still supports the point of the conditioner such that the third surface faces the arm.

20. The method of claim 18, wherein the cleaning the conditioner comprises:

spraying a cleaning agent to the conditioner; and brushing the conditioner.

* * * * *